US007540340B2

(12) United States Patent
Richman

(10) Patent No.: US 7,540,340 B2
(45) Date of Patent: Jun. 2, 2009

(54) CUTTING ELEMENT HAVING ENHANCED CUTTING GEOMETRY

(75) Inventor: Lance T. Richman, Ponca City, OK (US)

(73) Assignee: Smith International, Inc., Houston, TX (US)

( * ) Notice: Subject to any disclaimer, the term of this patent is extended or adjusted under 35 U.S.C. 154(b) by 339 days.

(21) Appl. No.: 11/475,448

(22) Filed: Jun. 27, 2006

(65) Prior Publication Data

US 2006/0237235 A1 Oct. 26, 2006

Related U.S. Application Data

(63) Continuation-in-part of application No. 10/636,301, filed on Aug. 6, 2003, now Pat. No. 7,086,488.

(60) Provisional application No. 60/423,561, filed on Nov. 4, 2002.

(51) Int. Cl.
*E21B 10/52* (2006.01)

(52) U.S. Cl. ..... 175/374; 175/426

(58) Field of Classification Search ..... 175/374, 175/426

See application file for complete search history.

(56) References Cited

U.S. PATENT DOCUMENTS 4,058,177 A 11/1977 Langford, Jr. et al.
4,334,586 A 6/1982 Schumacher
4,343,371 A 8/1982 Baker, III et al.
4,811,801 A 3/1989 Salesky et al.
5,152,194 A 10/1992 Keshavan et al.
5,172,777 A 12/1992 Siracki et al.
5,351,769 A 10/1994 Scott et al.
5,351,771 A 10/1994 Zahradnik
5,791,423 A 8/1998 Overstreet et al.
5,881,828 A 3/1999 Fischer et al.
6,029,759 A 2/2000 Sue et al.
6,145,605 A 11/2000 Karlsson et al.
6,290,008 B1 9/2001 Portwood et al.
6,460,637 B1 10/2002 Siracki et al.
6,604,588 B2 8/2003 Eyre et al.
7,086,488 B2 * 8/2006 Richman ..... 175/374

* cited by examiner

*Primary Examiner*—Hoang Dang
(74) *Attorney, Agent, or Firm*—Osha Liang LLP

(57) ABSTRACT

A drill bit having a bit body, at least one roller cone attached to the bit body and able to rotate with respect to the bit body, and a plurality of cutting elements disposed on the at least one roller cone is disclosed. At least one of the plurality of cutting elements includes a first area defining a trailing edge, a second area proximate the first area defining a main wear surface, and a third area proximate the second area and defining a leading edge relief zone. Further, an insert for a drill bit having a contact portion adapted to contact an earth formation, the contact portion including a first area defining a relieved trailing edge, a second area defining a main wear surface, and a third area proximate the second area and defining a leading edge relief zone.

15 Claims, 4 Drawing Sheets

CUTTING ELEMENT HAVING ENHANCED CUTTING GEOMETRY

CROSS-REFERENCE TO RELATED APPLICATIONS

This application is a continuation-in-part of co-pending U.S. patent application Ser. No. 10/636,301, filed on Aug. 6, 2003, which claims benefit to U.S. Provisional Application No. 60/423,561, filed Nov. 4, 2002, and claims the benefit, pursuant to 35 U.S.C. § 120, of that application. Both applications are incorporated by reference in their entirety.

BACKGROUND ART

1. Field of the Invention

The invention relates generally to roller cone drill bits for drilling earth formations, and more specifically to the geometry of cutting elements on roller cone drill bits.

2. Background Art

FIG. 1 shows one example of a roller cone drill bit used in a conventional drilling system for drilling a well bore in an earth formation. The drilling system includes a drilling rig 100 used to turn a drill string 120 which extends downward into a well bore 140. Connected to the end of the drill string 120 is roller cone-type drill bit 200.

In roller cone bits, the cutting elements drill the earth formation by a combination of compressive fracturing and shearing action. Prior art milled tooth bits typically have teeth formed from steel or other easily machinable high-strength material, to which a hardface overlay such as tungsten carbide or other wear resistant material is often applied. The hardfacing is applied by any one of a number of well known methods. There are a number of references which describe specialized exterior surface shapes for the substrate.

The specialized shapes are intended to provide a cutting structure which includes more thickness of hardface overlay in wear-prone areas, so that the useful life of the teeth can be increased. Examples of such specialized substrate shapes are shown in U.S. Pat. Nos. 5,791,423, 5,351,771, 5,351,769, and 5,152,194, for example. These references show that the teeth have substantially regular trapezoidal exterior hardface surfaces. The irregular shape of the substrate outer surface is selected to provide additional hardface in the wear prone areas while maintaining a conventional exterior tooth surface.

U.S. Pat. No. 6,029,759 issued to Sue et al shows a milled tooth drill bit having teeth in a gage row (the outermost row of teeth on any cone used to maintain full drilling diameter), wherein the teeth have a particular outer surface. See for example FIG. 12B in Sue et al '759. The particular outer surface of these teeth is intended to make it easier to apply hardfacing in two layers, using two different materials. The purpose of such tooth structures is to have selected hardfacing materials positioned to correspond to the level of expected wear on the various positions about the outer surface of the tooth.

Polycrystalline diamond ("PCD") enhanced inserts and tungsten carbide ("WC—Co") inserts are two commonly used inserts for roller cone rock bits and hammer bits. A roller cone rock bit typically includes a bit body adapted to be coupled to a rotatable drill string and include at least one "cone" that is rotatably mounted to the bit body. The cone typically has a plurality of inserts pressed into it. The inserts contact with the formation during drilling.

The PCD layer on PCD enhanced inserts is extremely hard. As a result, the PCD layer has excellent wear resistance properties. While the actual hardness of the PCD layer varies for the inserts used in particular bit types, each type of PCD has a common failure mode of chipping and spalling due to cyclical impact loading on the inserts during drilling. Conversely, the softer, tougher tungsten carbide inserts tend to fail by excessive wear and not by chipping and spalling. Therefore, a need exists for inserts for roller cone bits that are optimized for resisting both wear and impact as encountered during drilling.

SUMMARY OF INVENTION

In one aspect, the present invention relates to a drill bit that includes a bit body, at least one roller cone attached to the bit body and able to rotate with respect to the bit body, and a plurality of cutting elements disposed on the at least one roller cone, at least one of the plurality of cutting elements includes a first area defining a secondary wear surface, wherein the first area is formed as a surface on a trailing edge of the at least one cutting element, a second area proximate the first area and defining a main wear surface, wherein the second area has a radius of curvature substantially equal to a radius of a borehole, and a third area proximate the second area and defining a leading edge relief zone.

In another aspect, the present invention relates to an insert for a drill bit that includes a barrel axis, a contact portion adapted to contact an earth formation, the contact portion further including a first area defining a relieved trailing edge, and a second area proximate to the first area and defining a main wear surface, wherein a surface of the second area has a radius of curvature substantially equal to a radius of a borehole, and a third area proximate the second area and defining a leading edge relief zone.

In another aspect, the present invention relates to an insert for a drill bit that includes a bit body, at least one roller cone attached to the bit body and able to rotate with respect to the bit body, and a plurality of cutting elements disposed on the at least one roller cone, at least one of the plurality of cutting elements includes a first area defining a secondary wear surface, wherein the first area is formed as a surface on a trailing edge of the at least one cutting element, a second area proximate the first area and defining a main wear surface, wherein the second area has a radius of curvature substantially equal to a radius of a borehole, and a third area proximate the second area and defining a leading edge relief zone. The drill bit further includes a fourth area defining a spherical cutting surface, and a non-spherical transition zone disposed between the fourth area and he first and second areas, wherein the transition zone intersects the barrel axis.

In another aspect, the present invention relates to an insert for a drill bit that includes a barrel axis, a contact portion adapted to contact an earth formation, the contact portion further including a first area defining a relieved trailing edge, and a second area proximate to the first area and defining a main wear surface, wherein a surface of the second area has a radius of curvature substantially equal to a radius of a borehole, and a third area proximate the second area and defining a leading edge relief zone. The insert further includes a fourth area defining a spherical cutting surface, and a non-spherical transition zone disposed between the fourth area and the first and second areas, wherein the transition zone intersects the barrel axis.

Other aspects and advantages of the invention will be apparent from the following description and the appended claims.

DETAILED DESCRIPTION

The present invention relates to an improved geometry for cutting elements used in roller cone drill bits. In particular, certain embodiments relate to an insert having an optimized shape for rotary drilling mechanics. As used herein, the term "cutting element," is used to generically refer to different types of teeth used on bits (e.g., milled teeth and inserts).

Figure 1:
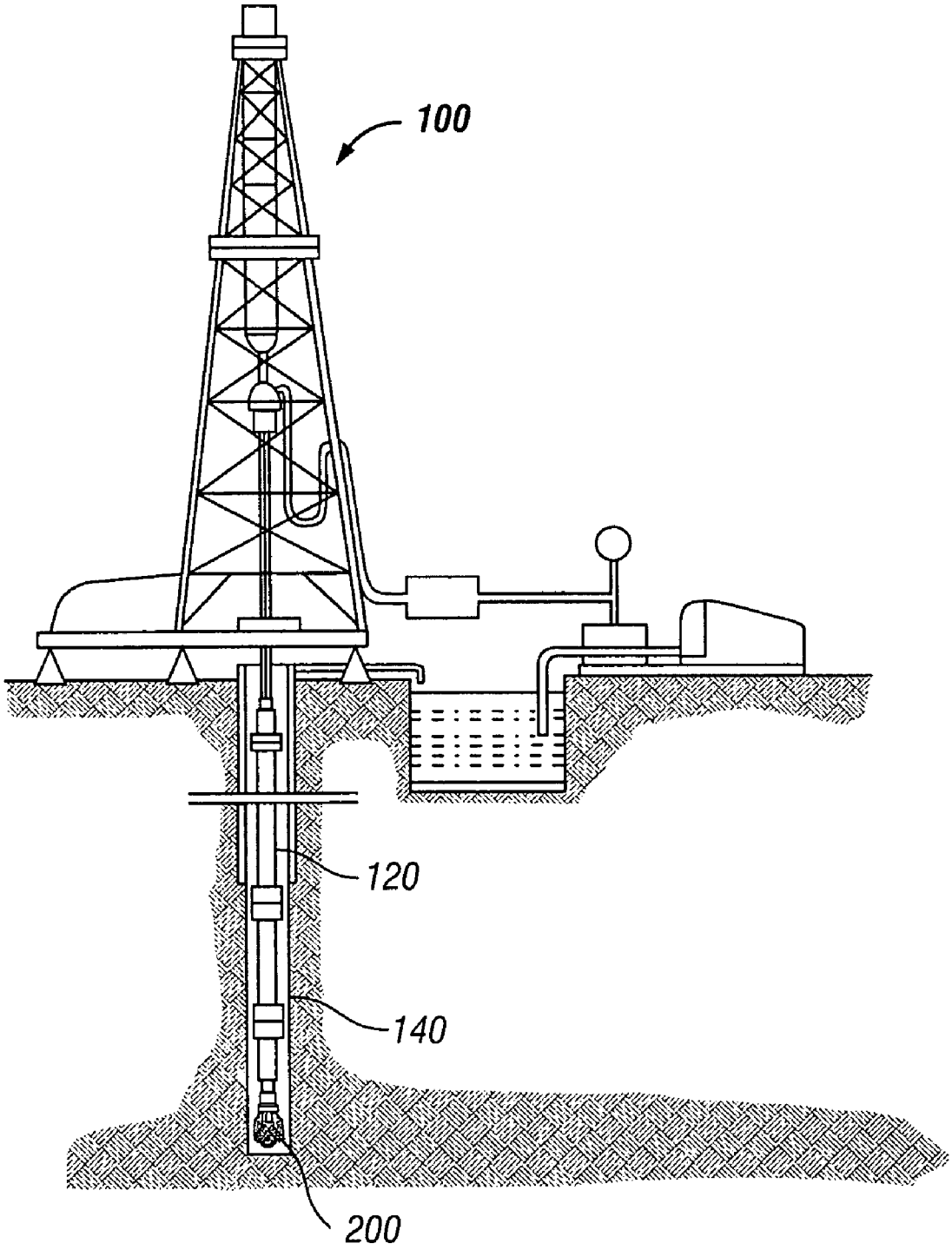
FIG. 1 (Prior Art)
FIG. 1 shows a schematic diagram of a drilling system for drilling earth formations having a drill string attached at one end to a roller cone drill bit.
Figure 2:
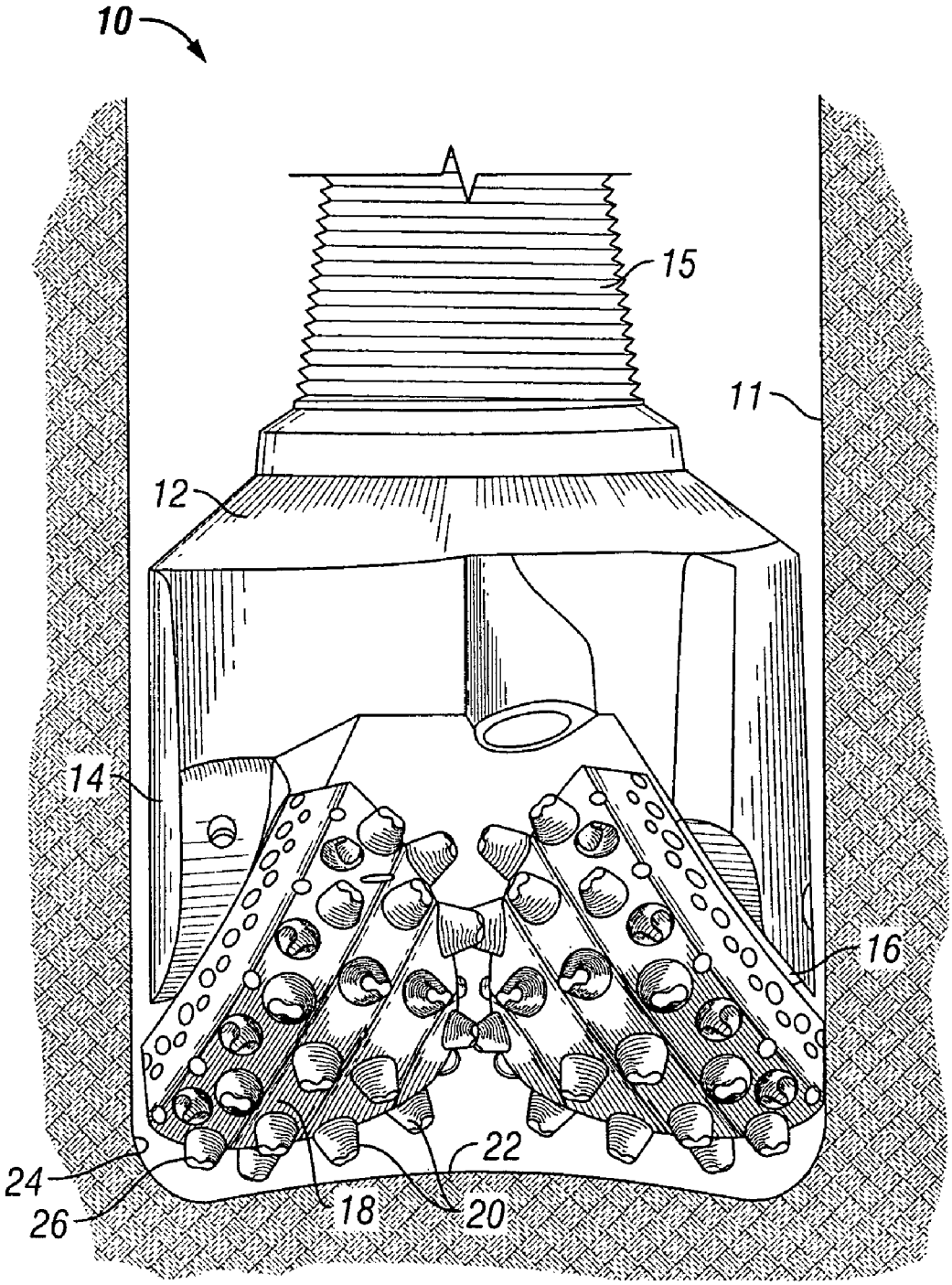
FIG. 2 shows a roller cone bit having inserts in accordance with an embodiment of the present invention.

Referring to FIG. 2, a roller cone rock bit 10 according to the preferred roller cone bit embodiment of the present invention, is shown disposed in a borehole 11. The bit 10 has a body 12 with legs 14 extending generally downward, and a threaded pin end 15 opposite thereto for attachment to a drill string (not shown). Journal shafts 16 are cantilevered from legs 14. Rolling cutters (or roller cones) 18 are rotatably mounted on the journal shafts 16. Each cutter 18 has a plurality of inserts 20 mounted thereon.

As the body 12 is rotated by rotation of the drill string (not shown), the cutters 18 rotate over the borehole bottom 22 and maintain the gage of the borehole by rotating against a portion of the borehole sidewall 24. As the cutter 18 rotates, individual inserts are rotated into contact with the formation and then out of contact with the formation. As a result, the inserts undergo cyclical loading which can contribute to fatigue failure. Inserts 26 are called "gage" inserts because they contact, at least partially, the sidewall 24 to maintain the gage of the borehole 11. All of the inserts, and particularly gage inserts 26, undergo repeated impact loading as they are rotated into and out of contact with the earth formation. In the present invention, at least one insert on the roller cone rock bit 10 has an improved cutting structure, as described below.

In different embodiments, inserts designed in accordance with the present invention may comprise a composite PCD material. Preferably for a roller cone bit application, the insert has a hardness of between about 1000 to 3000 Vickers Hardness Units (HV). This hardness provides a resulting increase in impact resistance that is beneficial for inserts used in roller cone drill bits, while not significantly sacrificing wear resistance. However, inserts having hardnesses well outside this range may be used.

In other embodiments, inserts designed in accordance with the present invention may comprise tungsten carbide inserts. One of ordinary skill in the art will recognize that the type of insert material is not as significant as the improved geometries of the insert, which are described below. Accordingly, it is expressly within the scope of the present invention that various compositions (be it boron-nitride containing, tungsten-carbide containing, PCD, etc.) may be used with the below described geometry.

Figure 3:
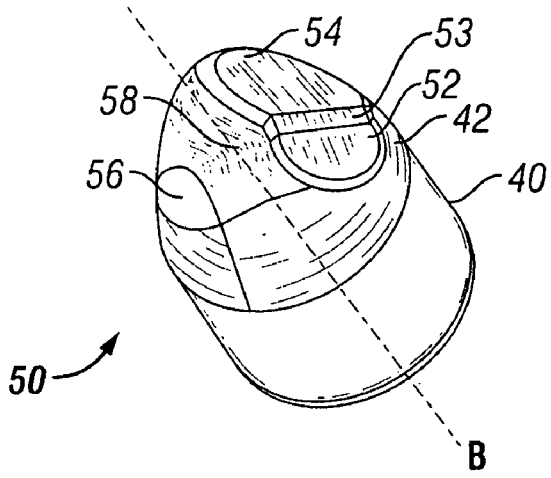
FIG. 3 shows an exploded view of an insert formed in accordance with an embodiment of the present invention.

Referring to FIG. 3, one embodiment of an insert 50 according to the present invention is shown. The insert 50 may be used as any one of the inserts on a cone or blade but has particular application as a gage insert. Accordingly, the following description is made in reference to insert 50 being a gage insert. Insert 50 comprises a substrate having a grip portion 40 and an extension portion 42. The grip portion 40 is sized for a press fit within sockets formed in rolling cutters (18 in FIG. 2). The extension portion has a outer layer (not shown) that contacts the borehole (not shown), which is referred to as the contact surface (not separately numbered). In this particular embodiment, the contact surface comprises first, second, third, and fourth "enhanced" areas that improve the rate of penetration and/or the life of the insert.

The first area 52 comprises a convex relief located on the trailing edge of the insert 50. This first area 52 acts as a secondary wear surface and is used to reduce the wear rate as well as heat generation due to the insert 50 dragging on the bore sidewall as it exits the formation. By removing material from the trailing edge on the insert 50 (to form the first area 52), a relieved surface is formed and therefore, eliminates what would otherwise be an unsupported extension that could lead to insert breakage. Thus, the relief area reduces the stress on the trailing side of the insert as it exits the hole wall in a sheering motion.

The second area 54 acts as a main wear surface for the insert 50. This main wear surface is important to reduce the rate at which the insert wears or erodes away. Notably, the second area 54 is not flat, but rather, in one embodiment, has a large radius (L) similar to that of the hole being drilled, in order to increase the surface area of the insert that makes contact with the bore wall. One of ordinary skill in the art will appreciate that depending on the size of the bit, drill string, insert, etc., the size of the radius L will vary. However, the actual size of the radius is not significant, instead, providing a radius of curvature approximate to the radius of the borehole is the significant step.

As noted above, in the preferred embodiment, the insert has a radius of curvature substantially similar to the radius of the borehole being drilled. However, it is expressly within the scope of the present invention that the radii can vary by as much as 100%. Further, while the main wear surface has been described as a convex surface, in some embodiments, the main wear surface is a planar surface.

By providing a convex surface having a relatively large diameter, the second area 54 distributes wear over a larger area of the insert, decreasing the amount of wear that any one particular portion of the insert is subjected to. Furthermore, decreasing stress on the insert results in a decreased chance of insert breakage.

Figure 4:
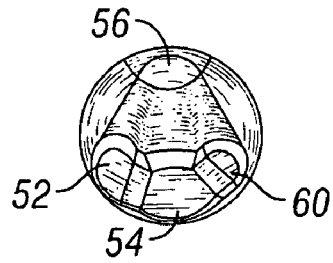
FIG. 4 shows a top view of an insert formed in accordance with an embodiment of the present invention.

Referring now to FIG. 4, a top view of a cutting element in accordance with an embodiment of the present invention, is shown. As described above, first area 52 is illustrated proximate to second area 54. Additionally, a third area 60 is located proximate to second area 54, and a fourth area 56 is disposed on insert 50. In this embodiment, third area 60 includes a leading edge relief zone illustrated adjacent to second area 54 and opposite first area 52. As such, third area 60 includes a relieved surface that is located on the leading edge of the primary wear surface.

Third area 60 allows insert 50 to engage formation in such a manner that stresses are distributed over a larger portion of the leading edge of the main wear surface. Because stresses are distributed over a larger area, the potential for insert 50 fracture along the leading edge of the primary wear surface may be reduced. In certain embodiments, third area 60 may be substantially smaller than the primary wear surfaces. However, one of ordinary skill in the art will recognize that third area 60 is not generally a primary wear surface, but functions as a stress relief for the leading edge of the primary wear surface. As such, a smaller relief area (third area 60) may help distribute stresses over a larger area, thereby increasing insert 50 integrity.

Referring back to FIG. 3, fourth area 56 is disposed on insert 50. In a preferred embodiment, the fourth area 56 is a spherical cutting surface adapted to penetrate the hole bottom. Accordingly, while the first and second areas (52 and 54, respectively), are scraping the hole sidewall, the fourth area 56 scrapes the hole bottom, and removes formation. A transition zone 58, located between the fourth area 56 and the first and second areas (52,54) may be significant because it forms a wedge shape. This wedge shape (formed from the geometry of the three areas) helps to increase the size of rock fracture. In a preferred embodiment, the transition zone 58 is slightly bowed outward in order to maximize carbide volume and reduce insert stress.

This wedge shape, located, in this embodiment, between the fourth surface and the first and second surfaces, represents a significant improvement over typical prior art inserts. In particular, embodiments of the present invention provide the wedge shape in a plane nearly perpendicular to the insert barrel axis B. Typical chisel inserts have a wedge shape in a plane that passes through the axis of the insert barrel B. It has been discovered that additional advantages, such as those described above, result from the geometry of the present invention.

What is significant, however, is the overall shape and relative orientation of the transition zone. As described above, preferably, the transition zone has an overall wedge shape and is disposed such that the wedge is perpendicular to a barrel axis B of the chisel. One of ordinary skill in the art, having reference to this disclosure, would understand the variations that fall within this general description.

Figure 5:
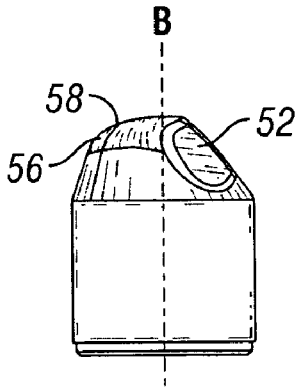
FIGS. 5-7 show various side views of an insert formed in accordance with an embodiment of the present invention.
Figure 6:
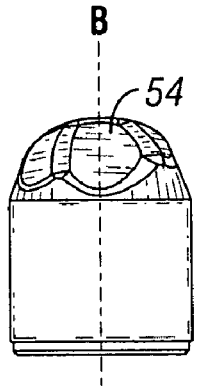
Figure 7:
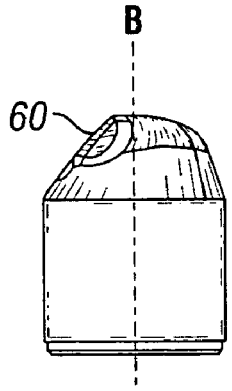

Referring briefly to FIGS. 5, 6, and 7 together, side profiles views of a cutting element in accordance with embodiments of the present invention, are shown. In this embodiment, first area 52 is illustrated proximate second area 54. Third area 60 extends as leading edge relief from second area 54. Finally, insert barrel axis B intersects a transition zone 58 therein formed between first, second, and third areas 52, 54, 60 and fourth area 56. In such an embodiment, one of ordinary skill in the art will recognize that third area 60 is located opposite first area 52. Thus, as first area 52 and second area 54 contact the sidewalls of a borehole, third area 60 may provide stress relief for second area 54, and fourth area 56 may contact the bottom of the borehole.

In alternate embodiments, insert barrel axis B may intersect transition zone 58, therein formed between first and second areas 52, 54, and fourth area 56. In such an embodiment, transition zone 58 would not be formed proximate to third area 60. Likewise, in certain embodiments, insert barrel axis B may intersect transition zone 58, therein formed between either first or second area 52, 54, third area 60, and fourth area 56. Finally, one of ordinary skill in the art will realize that transition zone 58 may be formed proximate to fourth area 56 and any area of a first, second or third area 52, 54, 60, independently or in any combination thereof.

Figure 8:
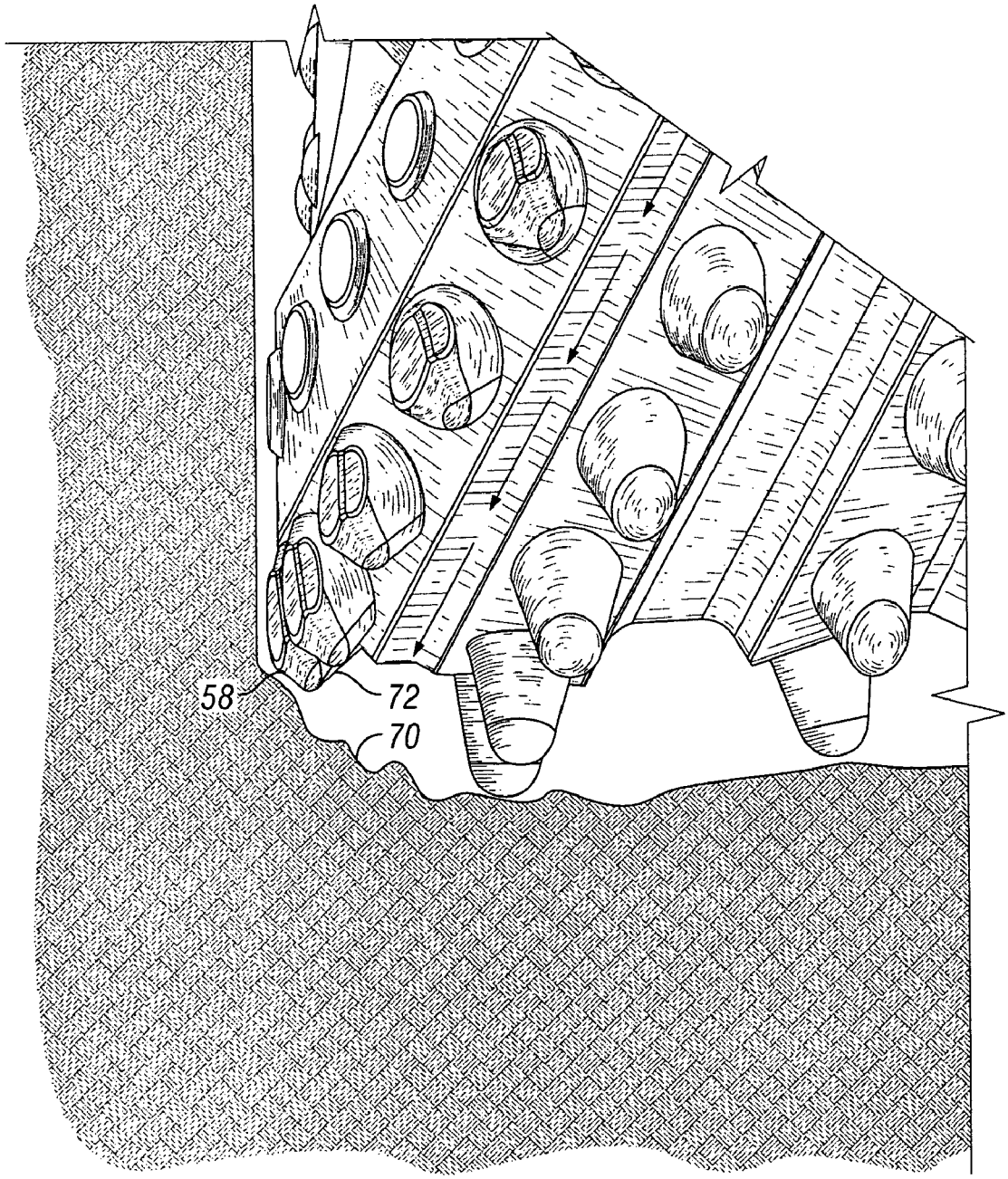
FIG. 8 shows inserts designed in accordance with one embodiment of the present invention disposed on a gage row.

FIG. 8 shows one embodiment of inserts designed in accordance with embodiments of the present invention interacting with a borehole 70. In FIG. 8, a gage insert 72, is shown contacting a sidewall (not separately numbered) of the borehole 70. From this figure, the interaction of the insert 72 with the sidewall 70 may be understood. Further, while this figure shows enhanced geometry inserts disposed on a gage row of a roller cone, it is expressly within the scope of the present invention that cutting elements (whether insert or milled tooth) having the improved geometry may be disposed in any fashion on the roller cone or cones.

Further, FIG. 8 shows transition zone 58 contacting the borehole 70. From this figure, the overall "wedge-shape" of the transition zone 58 is clearly seen. As shown in this embodiment, transition zone 58 is disposed such that transition zone 58 is in a plane substantially perpendicular to barrel axis B of gage insert 72. This is distinct compared with prior art inserts, which have "wedge-shaped" portions disposed in a plane substantially parallel to the barrel axis of the gage insert.

It should also be clearly understood that while the invention is described herein with reference to bits having cutting elements which are inserts made from hard material, such as tungsten carbide, and/or superhard material, such as diamond or cubic boron nitride, the shape of the exterior surface of selected cutting elements on a drill bit according to the invention is not limited to insert bits. Other roller cone bits known in the art, including those having cutting elements which are made from milled teeth having a hardfacing layer disposed thereon, are also within the scope of this invention.

It should also be noted that while the embodiments of the invention shown herein are described as being used with a bit having three roller cones, embodiments of the invention may include drill bits having any number of roller cones.

Advantageously, embodiments of the present invention including at least a leading edge relief zone adjacent a primary cutting surface may provide less fracture potential along the leading edge of the primary cutting surface. Because cutting elements including leading edge relief zones may exhibit less fracture potential, the cutting elements may allow improved rate of penetration, reduction of wear, and/or increases in the amount of formation cut with each rotation of the cone. Moreover, in one more embodiments having four areas, as discussed above, the resultant wedge shape may further increase the amount of rock fractured as compared to the prior art. In addition, because of the reduced stresses on the insert, harder carbide grades may be used.

The use of these harder grades of tungsten carbide further slows the insert wear rate. Accordingly, it is expressly within the scope of the present invention that any hardness range may be used. One of ordinary skill in the art, having reference to this disclosure, will recognize that the various properties of an insert in accordance with the present invention may be tailored, depending on the particular formation being drilled.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body;

at least one roller cone attached to the bit body and able to rotate with respect to the bit body; and a plurality of cutting elements disposed on the at least one roller cone, at least one of the plurality of cutting elements comprising:

a barrel axis;

a first area defining a secondary wear surface, wherein the first area is formed as a surface on a trailing edge of the at least one cutting element;

a second area proximate the first area and defining a main wear surface, wherein the second area has a radius of curvature substantially equal to a radius of a borehole;

a third area proximate the second area and defining a leading edge relief zone;

a fourth area defining a spherical cutting surface; and a non-spherical transition zone disposed between the fourth area and the first and second areas, wherein the barrel axis intersects the transition zone.

2. The drill bit of claim 1, wherein the first area defines a relief area.

3. The drill bit of claim 1, wherein the third area defines a relief area.

4. The drill bit of claim 1, wherein the spherical cutting surface is arranged to interact with a bottom surface of a borehole.

5. The drill bit of claim 1, wherein the transition zone is disposed between the fourth area and the first, second, and third areas.

6. The drill bit of claim 1, wherein the transition zone defines a wedge-shaped surface.

7. The drill bit of claim 5, wherein the transition zone lies in a plane substantially perpendicular to the barrel axis of the at least one cutting element.

8. The drill bit of claim 1, further comprising a transition zone disposed between the fourth area and the second and third areas, wherein the transition zone intersects the barrel axis.

9. The drill bit of claim 1, wherein the third area is substantially the same size as the second area.

10. An insert for a drill bit comprising:

a barrel axis;

a contact portion adapted to contact an earth formation, the contact portion comprising:

a first area defining a relieved trailing edge;

a second area proximate to the first area and defining a main wear surface, wherein a surface of the second area has a radius of curvature substantially equal to a radius of a borehole;

a third area proximate the second area and defining a leading edge relief zone;

a fourth area defining a spherical cutting surface; and a non-spherical transition zone, wherein the barrel axis intersects the transition zone.

11. The insert of claim 10, wherein the transition zone is disposed between the fourth area and the first, second, and third areas.

12. The insert of claim 11, wherein the transition zone lies in a plane substantially perpendicular to the barrel axis of the insert.

13. The insert of claim 10, wherein the first area and the second area are arranged to interact with a sidewall of a borehole.

14. An insert for a drill bit comprising:

a barrel axis;

a contact portion adapted to contact an earth formation, the contact portion comprising:

a first area defining a relieved trailing edge;

a second area proximate to the first area and defining a main wear surface, wherein a surface of the second area is a convex curved surface having a radius of curvature substantially equal to a radius of a borehole;

a third area proximate the second area and defining a leading edge relief zone, wherein the third area is radially separated from the first area;

a fourth area defining a spherical cutting surface; and a transition zone disposed between the fourth area and the first, second, and third areas, wherein the transition zone intersects the barrel axis.

15. A drill bit comprising:

a bit body;

at least one roller cone attached to the bit body and able to rotate with respect to the bit body; and a plurality of cutting elements disposed on the at least one roller cone, at least one of the plurality of cutting elements comprising:

a barrel axis;

a first area defining a secondary wear surface, wherein the first area is formed as a convex surface on a trailing edge of the at least one cutting element;

a second area proximate the first area and defining a main wear surface, wherein the second area is formed as a convex curved surface having a radius of curvature substantially equal to a radius of a borehole;

a third area proximate the second area and defining a leading edge relief zone, wherein the third area is radially separated from the first area;

a fourth area defining a spherical cutting surface; and a transition zone disposed between the fourth area and the first, second, and third areas, wherein the transition zone intersects the barrel axis.

* * * * *